US011053724B2

(12) United States Patent
Awad

(10) Patent No.: US 11,053,724 B2
(45) Date of Patent: Jul. 6, 2021

(54) DEVICE TO ASSIST IN CLOSING DOORS

(71) Applicant: Tony Awad, Ottawa (CA)

(72) Inventor: Tony Awad, Ottawa (CA)

( * ) Notice: Subject to any disclaimer, the term of this patent is extended or adjusted under 35 U.S.C. 154(b) by 0 days.

(21) Appl. No.: 16/519,772

(22) Filed: Jul. 23, 2019

(65) Prior Publication Data

US 2021/0025210 A1 Jan. 28, 2021

(51) Int. Cl.

| | |
|---|---|
| ***E05B 1/00*** | (2006.01) |
| ***E05F 9/00*** | (2006.01) |
| ***E05F 11/54*** | (2006.01) |
| ***E05F 11/12*** | (2006.01) |

(52) U.S. Cl.

CPC ..... *E05F 9/00* (2013.01); *E05F 11/12* (2013.01); *E05F 11/54* (2013.01)

(58) Field of Classification Search

CPC . E05B 5/003; E05B 5/00; E05B 5/006; E05B 47/0012; E05B 2047/002; E05B 2047/0014; E05B 2047/0018; E05F 9/00; E05F 11/12; E05F 11/54

See application file for complete search history.

(56) References Cited

U.S. PATENT DOCUMENTS

| | | | | | |
|---|---|---|---|---|---|
| 121,168 | A * | 11/1871 | Hannan | A47J 45/063 | 16/446 |
| 2,088,476 | A * | 7/1937 | Kemper | A61G 17/041 | 16/439 |
| 2,599,054 | A * | 6/1952 | Gates | E05B 5/003 | 292/348 |
| 3,480,990 | A * | 12/1969 | Bouwma | A47B 95/02 | 16/418 |
| 4,686,742 | A * | 8/1987 | Arnold | E05B 1/0015 | 16/412 |
| 4,817,239 | A | 4/1989 | Campbell et al. | | |
| 4,926,965 | A * | 5/1990 | Fox | B63B 27/14 | 114/362 |
| 5,042,676 | A * | 8/1991 | Gohlke | B65D 25/2841 | 220/759 |
| 5,231,731 | A | 8/1993 | Jones, Jr. | | |
| 5,269,044 | A * | 12/1993 | Marion | B25G 3/38 | 114/362 |
| 5,540,468 | A | 7/1996 | Fassman | | |
| 5,553,355 | A | 9/1996 | Baty | | |
| 5,855,408 | A * | 1/1999 | Rickabus | B60N 3/023 | 105/354 |

(Continued)

FOREIGN PATENT DOCUMENTS

| | | | | |
|---|---|---|---|---|
| GB | 2478366 | A * | 9/2011 | E05C 17/54 |
| JP | 2002177077 | A * | 6/2002 | |

*Primary Examiner* — Chuck Y Mah

(74) *Attorney, Agent, or Firm* — Moffat & Co

(57) ABSTRACT

There is provided a device to facilitate closing doors for people who use wheelchairs or have other mobility challenges. The device can be secured to an internal or external door surface using conventional means, at a height similar to the height of a typical door handle, but closer to the hinges than a typical door handle. The device comprises a base portion for securing the device to the door surface, an arm extending from the base portion, and a handle at the distal end of the arm. During operation, the device allows a person in a wheelchair to close the door by grabbing the handle of the device without positioning the wheelchair within the door frame. There is also provided a door with a device as described above.

8 Claims, 9 Drawing Sheets

(56) References Cited

U.S. PATENT DOCUMENTS

| | | | | |
|---|---|---|---|---|
| 5,975,606 | A * | 11/1999 | Forbes | B60N 3/023 16/421 |
| 6,048,125 | A * | 4/2000 | Droche | B60N 3/023 16/303 |
| 6,076,233 | A * | 6/2000 | Sasaki | B60N 3/026 16/438 |
| 6,289,557 | B1 | 9/2001 | Manson et al. | |
| 6,643,897 | B2 * | 11/2003 | Chang | B60N 3/023 16/248 |
| 6,751,827 | B1 | 6/2004 | Fok | |
| 7,624,966 | B2 * | 12/2009 | Dando | E05B 1/0053 254/120 |
| 7,938,464 | B1 * | 5/2011 | Hielm | A61F 4/00 294/175 |
| 8,353,546 | B1 | 1/2013 | Cacas | |
| 8,522,482 | B2 * | 9/2013 | Buck | E05B 1/0069 49/460 |
| 2002/0184736 | A1 * | 12/2002 | Nelson | E05F 11/54 16/412 |
| 2010/0320779 | A1 | 12/2010 | Yoo | |
| 2013/0326845 | A1 * | 12/2013 | Hinkle | A61H 3/00 16/429 |
| 2019/0390476 | A1 * | 12/2019 | Kightlinger | E05B 5/003 |

* cited by examiner

DEVICE TO ASSIST IN CLOSING DOORS

FIELD OF THE DISCLOSURE

The present disclosure relates to a device to assist individuals with handicaps in opening and closing doors.

BACKGROUND

The background description includes information that may be useful in understanding the present inventive subject matter. It is not an admission that any of the information provided herein is prior art or applicant admitted prior art, or relevant to the presently claimed inventive subject matter, or that any publication specifically or implicitly referenced is prior art or applicant admitted prior art.

Simple tasks such as opening or closing a door can become complicated for people with disabilities. For example, a person who is confined to a wheelchair or who uses a walker may find it difficult to close the door behind them as they leave a room, especially if the door opens towards the inside of the room. Therefore, there is a need for a device which assists people with disabilities in closing the door.

In some embodiments, the numbers expressing quantities of ingredients, properties such as concentration, reaction conditions, and so forth, used to describe and claim certain embodiments of the inventive subject matter are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY

The present disclosure is directed to a device comprising a base having a flat surface and an external surface, an arm extending from the external surface of the base, and a handle at a distal end of the arm.

The present disclosure is further directed to a door comprising a door body, and a device comprising a base having a flat surface and an external surface, an arm extending from the external surface of the base, and a handle at a distal end of the arm, the flat surface being secured to the door body.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The present disclosure will be better understood having regard to the drawings in which.

DETAILED DESCRIPTION OF THE DRAWINGS

Figure 1:
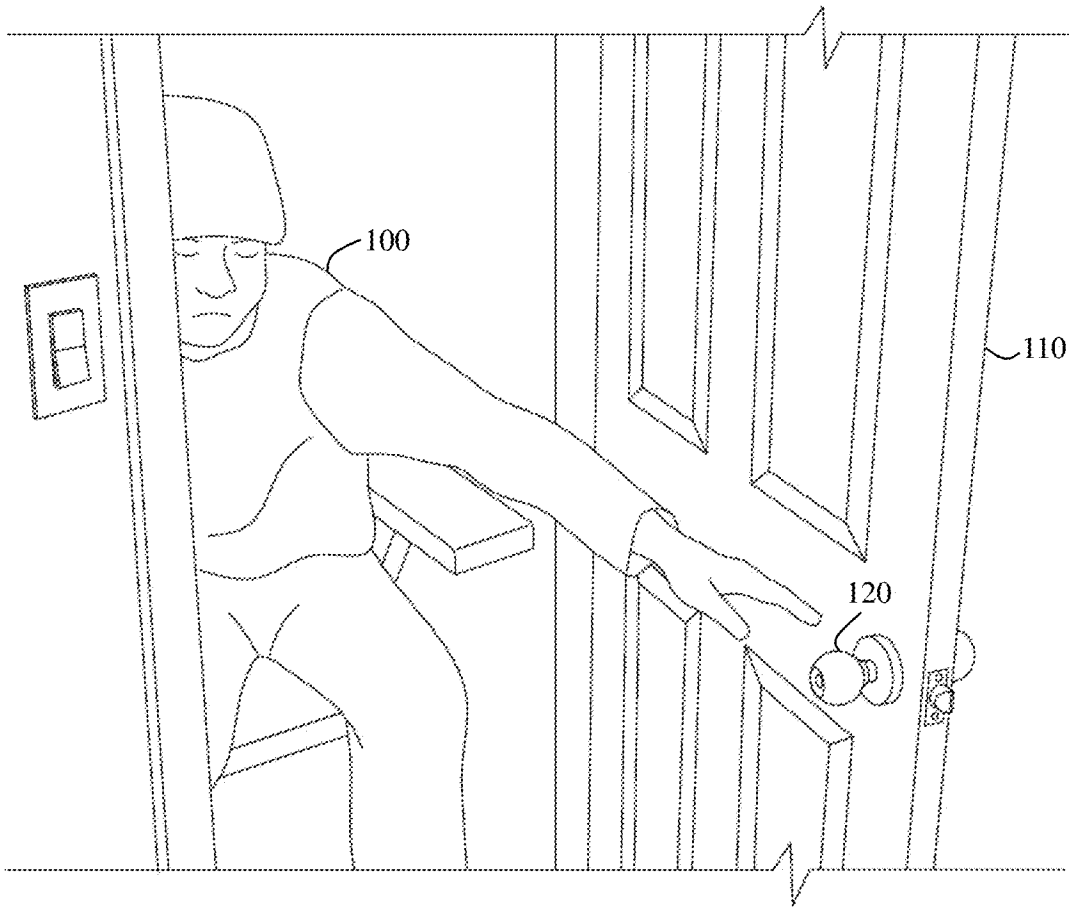
FIG. 1 shows a perspective view of a person in a wheelchair closing a door according to the prior art.

When a person who is in a wheelchair exits a room, it is difficult for them to close the door when the door opens inward. For example, as illustrated in FIG. 1, a person in a wheelchair 100 is exiting a room, and is attempting to close the door 110 behind them. However, the door knob is situated at the farthest possible point on the door, and reaching the door knob 120 can be very difficult, and may even require the person in the wheelchair 100 to position the wheelchair within the room to reach the door knob 120. As the door 110 closes, the person in the wheelchair 100 needs to simultaneously back up through the door frame, while reaching forward to reach door knob 120.

The situation described above occurs a very large number of times in the day to day life of a person in a wheelchair. In some scenarios, the person in the wheelchair may even fall, risking injury or a major inconvenience.

Accordingly, there is a need for an improved method of closing and opening doors for people in wheelchairs.

Figure 2:
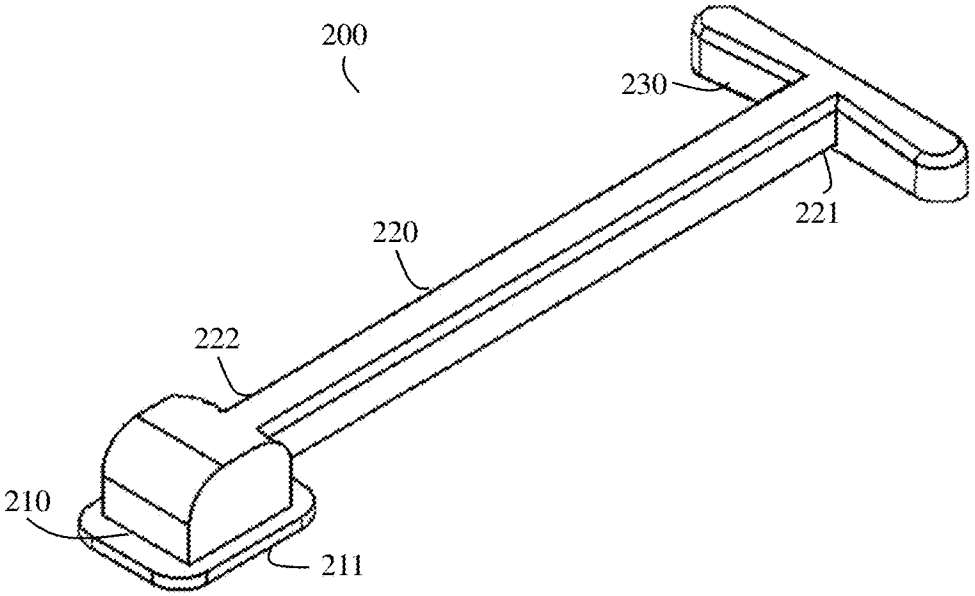
FIG. 2 shows a perspective view of a device according to at least one embodiment of the present disclosure.

Reference is now made to FIG. 2, which illustrates a device according to a first embodiment of the present disclosure. The device 200 comprises a base 210, an arm 220, and a handle 230. According to at least one embodiment, the base 210 comprises a flat surface 211 for facilitating attachment to a door surface, as will be described in greater detail below. The base 210 may also comprise a pair of holes for allowing screws or other means of securing the device to a door surface.

According to at least one embodiment, the base comprises a flat surface 211 having disposed thereon an adhesive substance. Alternatively, the flat surface 211 may be free of any adhesive substance, and an adhesive substance may be applied to surface 211 at the time of installation.

According to at least another embodiment, device 200 further comprises a separate anchor portion (not shown) comprising means for securing the anchor portion to a door surface. The means for securing the anchor portion to the door surface may include, but are not limited to, holes adapted to receive screws or nails, an adhesive substance, and other securing means known in the art. The anchor portion further comprises means for securing the base 210 of the device 200. For example, the anchor portion may comprise grooves on its internal sides' surfaces designed to cooperate with tongues extending from the side surfaces of the base 210 to secure the base 210 with the anchor portion. However, other means of securing the anchor portion with the base 210 are within the scope of the present disclosure and the present disclosure is not so limited.

Device 200 further comprises an arm 220 extending forwardly from the base 210. According to the embodiment illustrated in FIG. 2, the arm 220 is integrated with the base 210 as a single piece. In this embodiment, the arm 220 is fixed with respect to the base 210. Other embodiments where the arm may pivot relative to the base are discussed below.

As seen in FIG. 2, arm 220 extends in a direction which is parallel to the plane in which surface 211 resides. As will be appreciated, this plane corresponds substantially to the door surface when the device 200 is installed on a door. According to at least some embodiments, the arm 220 is separated from that plane by a sufficient distance to allow a person with a closed fist to easily grip or use the arm 220 when device 200 is installed on a door.

In other embodiments, arm 220 may extend in a direction away from surface 211, such that when the device 200 is installed on a door, the distal end 221 of arm 220 is further away from the door surface than proximal end 222. In yet another embodiment, arm 220 extends in a direction towards surface 211, such that when the device 200 is installed on a door, the distal end 221 of arm 220 is closer to the door surface than proximal end 222.

Device 200 further comprises a handle 230 located at distal end 221 of arm 220. The handle may form a T-shape as shown in FIG. 2, but other handle shapes are within the scope of the present disclosure. In at least one embodiment, the handle consists simply of the distal end of arm 220. Handle 230 allows the user to easily grab the device and close the door.

Figure 3:
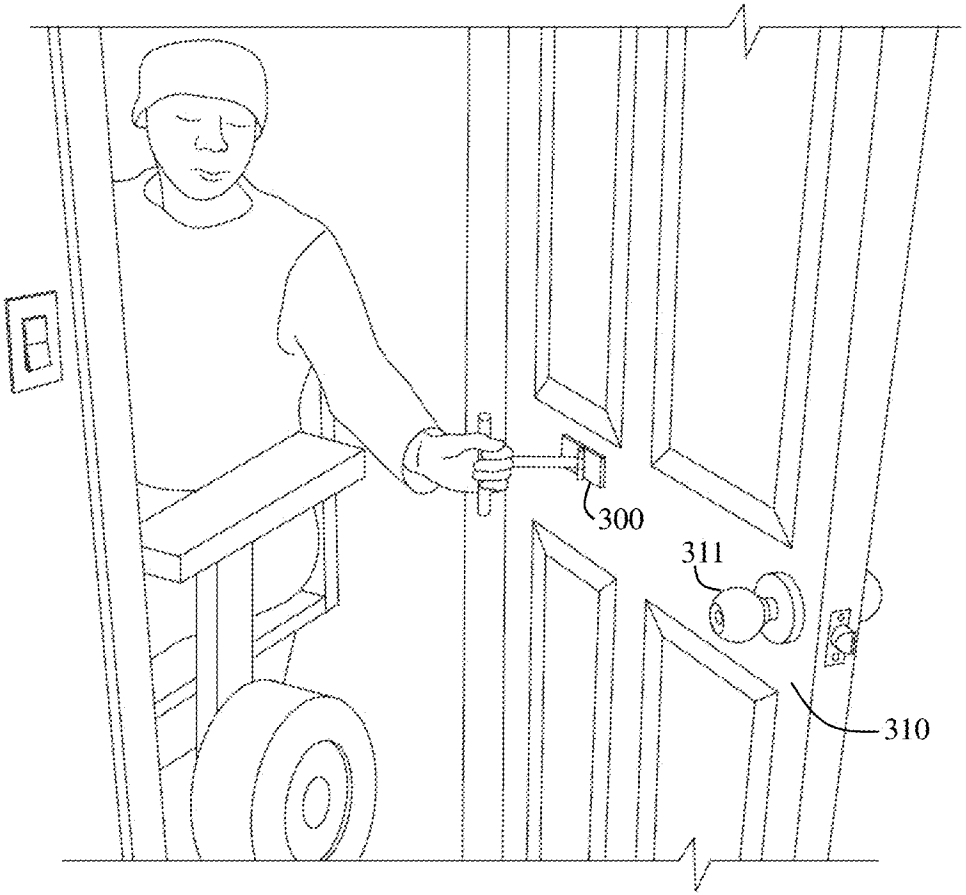
FIG. 3 shows a perspective view of a person in a wheelchair closing a door using a device according to the present disclosure.

Reference is now made to FIG. 3 which illustrates operation of the device. As can be seen in FIG. 3, the device 300 is installed on an external door surface 310. Typically, the device 300 is installed at a height comparable to the height where a door handle 311 is usually found. However, the device 300 may be installed at any height which is most convenient for the user. As described above, the device 300 may be installed on the door using various means, such as for example a flat surface of the base having an adhesive substance thereon, or by screwing the device to the door through holes provided for that purpose, amongst others.

Furthermore, device 300 is typically installed nearer to the door hinges than the door handle, as is shown in FIG. 3. This allows a person in a wheelchair to grab the device 300 from a position which is outside the door being closed, thereby making it easier for the person in the wheelchair to close the door. In particular, unlike the situation illustrated in FIG. 1, the person in the wheelchair does not need to be within the room to initially reach the door handle, which means that the person does not need to back up as the door is being closed.

While the example illustrated in FIG. 3 shows that the device is installed on an external door surface, the device can also be installed on an internal door surface, especially for doors which swing outwards.

Figure 4:
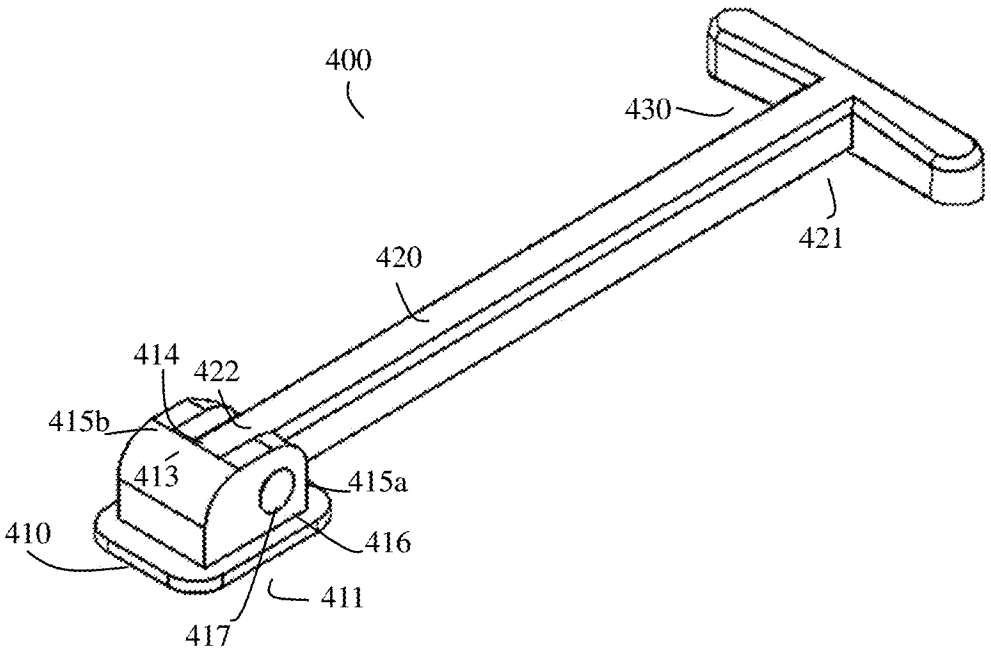
FIG. 4 shows a perspective view of a device according to at least one embodiment of the present disclosure.

Reference is now made to FIG. 4, which illustrates another embodiment of a device according to at least one embodiment of the present disclosure.

As seen in FIG. 4, device 400 comprise a base 410, an arm 420, and a handle 430.

The base 410 comprises a flat portion 411, for securing the device to a door surface as discussed above. As in the case of the embodiment illustrated in FIG. 2, any means for securing the device to the door surface is within the scope of the present disclosure, including, but not limited to providing an adhesive on flat portion 411, or providing holes to allow screws or nails to secure the base 410 to the door surface.

In this embodiment, the base 410 further comprises a hinge portion 413 for securing arm 420 to the base and for allowing arm 420 to pivot with respect to the base. The hinge portion comprises a cavity 414 for receiving the proximal end of arm 420. On each side of cavity 414 are shoulders 415*a* and 415*b*, the edges of which define cavity 414.

Within each shoulder 415*a* and 415*b*, bores 416 define a pivoting axis in which pin 417 is received. Specifically, as will be discussed further below, arm 420 comprises a bore (not shown) at its proximal end 421 which has a similar diameter as bores 416. When the proximal end 421 of arm 420 is inserted within cavity 414, bore 422 and bores 416 line up, allowing for pin 417 to be inserted through each of bores 416 and 422.

According to at least one embodiment, pin 417 is sized to fit snuggly within each of bores 416 and 422, such that pin 417 is held into place by friction between its external surface and the internal surface of bores 416 and 422. Bores 416 have a diameter which is slightly smaller than the diameter of bore 422. In one embodiment, the diameter of bores 416 is 0.1 mm smaller than the diameter of bore 422.

Figure 5B:
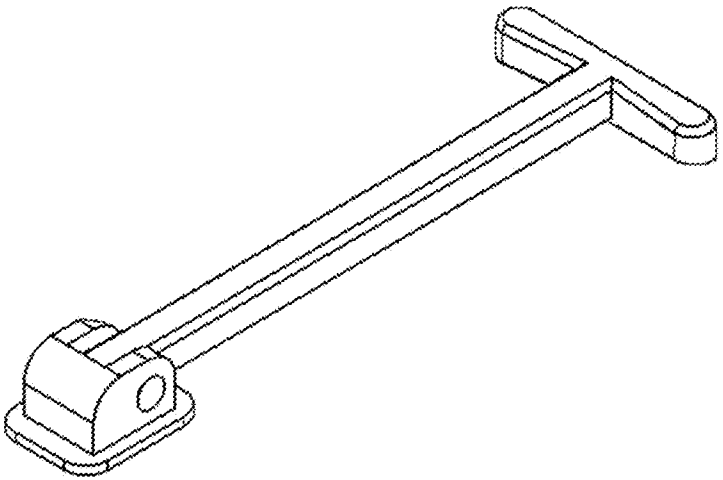
FIG. 5B shows a perspective view of a device according to at least one embodiment of the present disclosure.
Figure 5A:
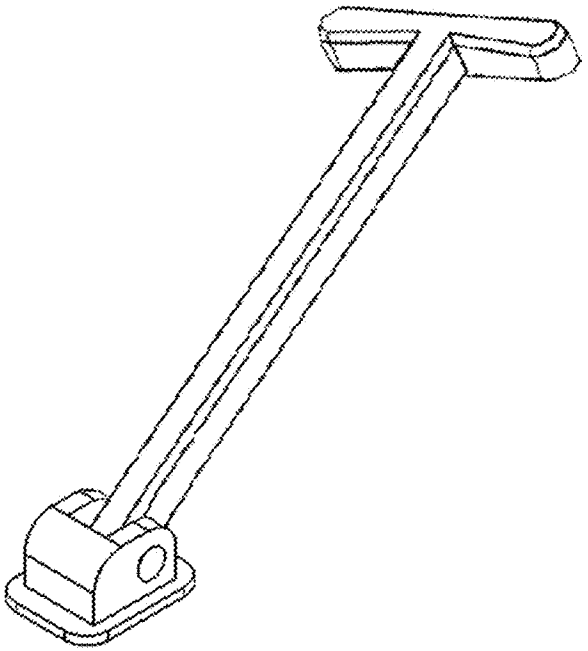
FIG. 5A shows a perspective view of a device according to at least one embodiment of the present disclosure.

With the arm 420 connected to the base 410 through hinge portion 413, as discussed above, the arm 420 may pivot from a first position shown in FIG. 5A to a second position shown in FIG. 5B.

According to at least one embodiment, arm 420 is sized so that it fits snuggly within cavity 414, such that it remains in place when undisturbed, but can be moved without applying significant force.

According to at least one embodiment, the hinge portion may comprise two parallel rails extending upwardly from the flat portion of the base to define a channel therebetween. Each rail has a bore extending therethrough from an external side surface to an internal side surface for receiving pins extending sideways from a proximal end of the arm. In this embodiment, the arm may be formed from a single piece of metal wire which is bent to form an arm portion, a handle portion, and terminating in two opposite ends bent substantially orthogonally from the arm portion to engage the bore in each rail. Alternatively, the arm may be formed from other material and be equipped, at its proximal end with two opposing pins extending sideways to engage the bore in each rail.

Figure 6:
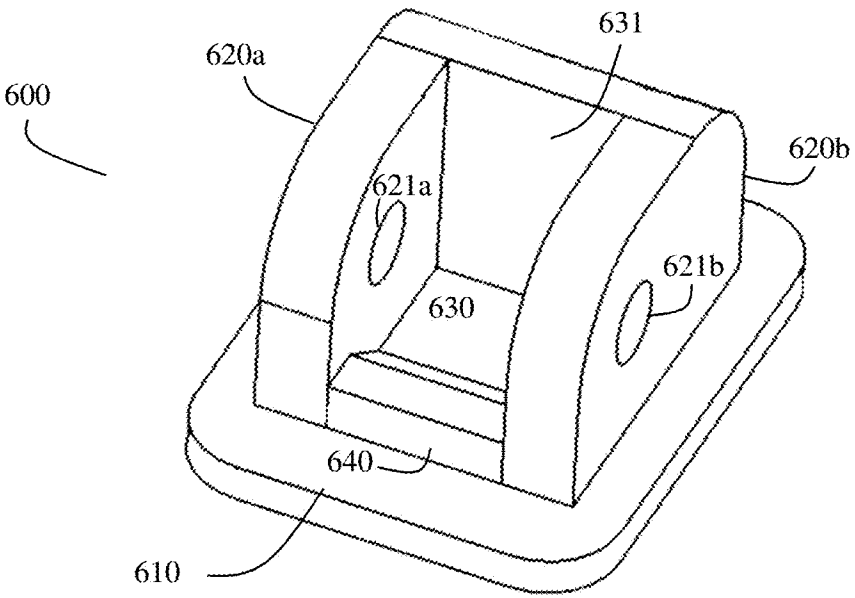
FIG. 6 shows a perspective view of a base of a device according to at least one embodiment of the present disclosure.

Reference is now made to FIG. 6, which illustrates a base of a device according to yet another embodiment of the present disclosure.

As seen in FIG. 6, base 600 comprise a flat portion 610, and shoulders 620*a* and 620*b*.

The base 600 comprises a flat portion 610, for securing the device to a door surface as discussed above. As in the case of the embodiment illustrated in FIG. 2, any means for securing the device to the door surface is within the scope of the present disclosure, including, but not limited to providing an adhesive on the bottom of flat portion 610, or providing holes to allow screws or nails to secure the base 600 to the door surface.

In this embodiment, as in the embodiment illustrated in FIG. 4, the base 600 further comprises a hinge portion 630 for securing an arm to the base 610 and for allowing the arm to pivot with respect to the base. However, unlike the embodiment illustrated in FIG. 4, in the embodiment of FIG. 6, the range of motion of arm is restricted to improve user experience.

Specifically, some people who require the use of a wheelchair have other conditions which may limit their dexterity. In particular, a condition known as "claw hand" may be caused by muscular dystrophy, or other underlying causes, which severely limits the amount of movement in the hands of people who are affected.

For people suffering from claw hand, or other similar conditions, and who also use a wheelchair, it may be difficult to grab the handle of a device of the present disclosure if the handle is resting on the door surface. Specifically, as illustrated in FIG. 5B, the handle may pivot to a position where the handle is touching the door surface. From this position, it may be difficult for some people to engage with the handle and close the door properly.

The embodiment illustrated in FIG. 6 prevents this situation by limiting the range of motion of the arm, as will be described in greater detail below.

Returning now to the embodiment illustrated in FIG. 6, the hinge portion 630 comprises a cavity 631 for receiving the proximal end of the arm. On each side of cavity 631 are shoulders 620*a* and 620*b*, the edges of which define cavity 631.

Within each shoulder 620*a* and 620*b*, bores 621*a* and 621*b* define a pivoting axis in which a pin is received for connecting an arm to the base 600. Specifically, as will be discussed further below, the arm comprises a bore at its proximal end which has a similar diameter as bores 621*a* and 621*b*. When the proximal end of the arm is inserted within cavity 631, the bore within the arm and bores 621*a* and 621*b* line up, allowing for a pin to be inserted through each of bores 621*a*, 621*b*, and the bore within the arm.

According to at least one embodiment, the pin is sized to fit snuggly within each of bores 621*a*, 621*b*, and the bore within the arm, such that the pin is held into place by friction between its external surface and the internal surface of bores 621*a*, 621*b*, and the bore within the arm.

In the embodiment of FIG. 6, hinge portion 630 further comprises a stop member 640 extending upwardly from flat portion 610. According to at least some embodiments, stop member 640 is located between shoulders 620*a* and 620*b*, within cavity 631. During operation, stop member 640 acts to prevent the arm from pivoting to a position where the handle touches the door surface.

According to at least some embodiments, the height of stop member 640, as measured from flat portion 610, is selected such that when the arm is resting on stop member 640, the arm is substantially parallel with flat portion 610. However, other heights are within the scope of the present disclosure, and the present disclosure is not so limited. For example, the height of stop member 640 may be selected such that the arm, when resting on stop member 640, has a distal end which is closer to the door surface (or flat portion 610) than its proximal end. Alternatively, the height of stop member 640 may be selected such that the arm, when resting on stop member 640, has a distal end which is farther away from the door surface (or flat portion 610) than its proximal end.

According to this embodiment, when installed on a door surface, a device comprising a base 600 allows the handle to be grasped easily without needing to separate the handle from the door surface.

With the arm connected to the base 600 through hinge portion 630, as discussed above, the arm may pivot from a first position shown in FIG. 5A to a second position where the arm is closer to the door surface while never touching the door surface.

According to at least one embodiment, the arm is sized so that it fits snuggly within cavity 631, such that it remains in place when undisturbed, but can be moved without applying significant force.

Alternatively, a spacer may be installed on the door at a position aligned with the arm of the device, such that when the arm is moved in a position towards the door, the spacer catches the arm and prevents it from touching the door. This allows space to remain between the handle and the door and allows for easy operation of the device for people lacking the ability to grasp objects with their hands. The spacer may be made of rubber, or any other suitable material.

Figure 7:
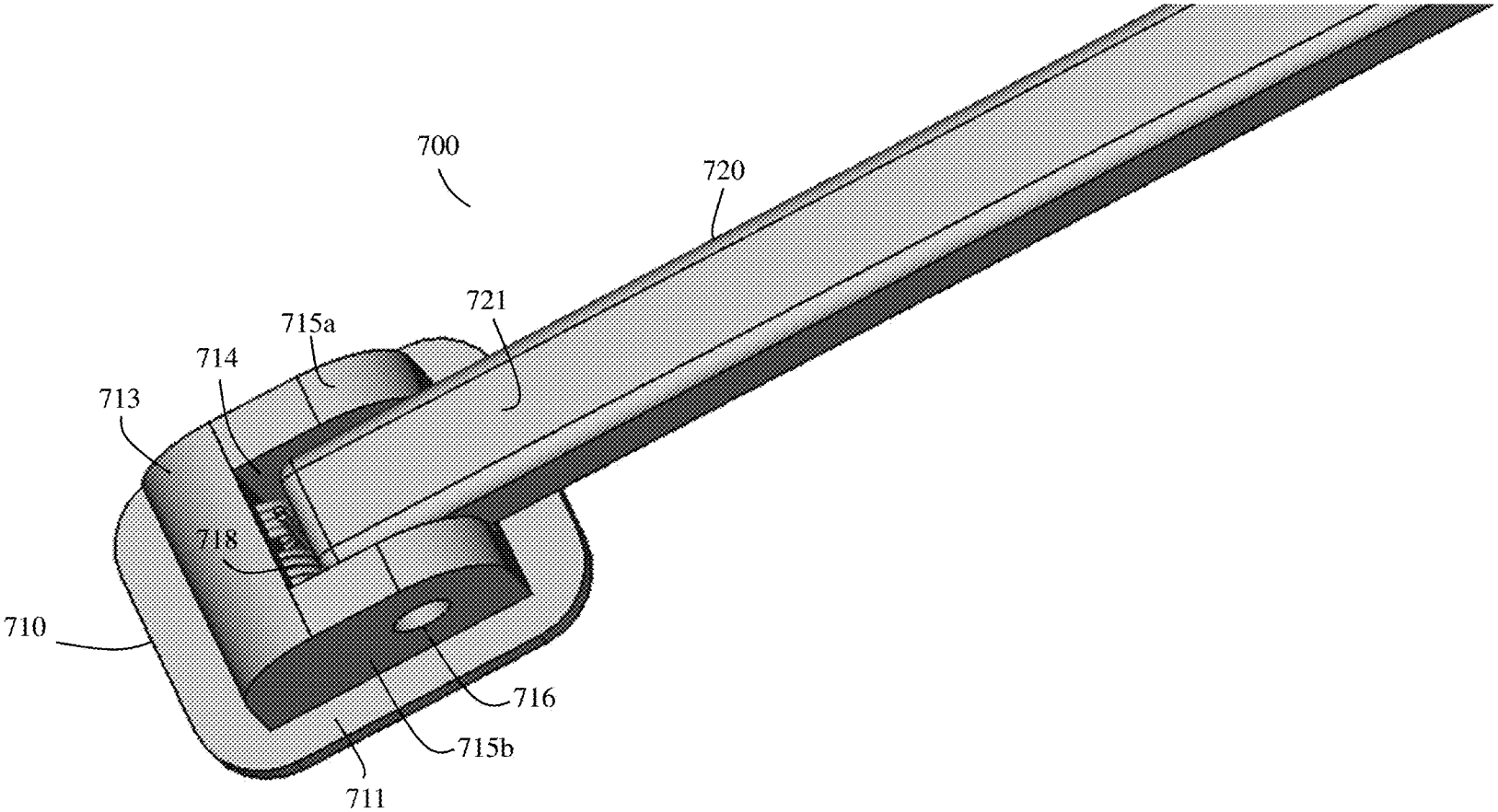
FIG. 7 shows a perspective view of a device according to at least one embodiment of the present disclosure.

Reference is now made to FIG. 7, which shows another embodiment of the present disclosure, in which the handle is biased towards the door using biasing means.

As seen in FIG. 7, device 700 comprise a base 710, and an arm 720.

The base 710 comprises a flat portion 711, for securing the device to a door surface as discussed above. As in the case of the embodiment illustrated in FIG. 2, any means for securing the device to the door surface is within the scope of the present disclosure, including, but not limited to providing an adhesive on bottom surface of flat portion 711, or providing holes to allow screws or nails to secure the base 710 to the door surface.

In this embodiment, as in the embodiment illustrated in FIG. 4, the base 710 further comprises a hinge portion 713 for securing arm 720 to the base and for allowing arm 720 to pivot with respect to the base. Hinge portion 713 comprises a cavity 714 for receiving the proximal end of arm 720. On each side of cavity 714 are shoulders 715*a* and 715*b*, the edges of which define cavity 714.

Within each shoulder 715*a* and 715*b*, bores 716 define a pivoting axis in which a pin is received. Arm 720 comprises a bore at its proximal end 721 which has a slightly smaller diameter than bores 716. When the proximal end 721 of arm 720 is inserted within cavity 714, the bore within arm 720 and bores 716 line up, allowing for a pin to be inserted through each of the bores.

According to at least one embodiment, the pin is sized to fit snuggly within the bore of arm 720, such that it is held into place by friction between its external surface and the internal surface of the bore.

The embodiment of FIG. 7 further comprises a double torsion spring 718 within cavity 714, underneath arm 720. Double torsion spring 718 comprises two legs, where each of the two legs extend forwardly from one end of their respective coils. The two separate coils are connected by a middle section which extends forwardly and defines an enclosure shaped to correspond to the cross-section of arm 720. The two legs may be secured to base 710 by pins extending laterally into holes on the internal surface of shoulders 715*a* and 715*b*. Arm 720 is secured within cavity 714, over double torsion spring 718, as discussed above, but leaving some room for the coils of double torsion spring 718 behind arm 720, as shown. The middle section of double torsion spring 718 is positioned above arm 720, near proximal end 721.

In operation, when arm 720 is extended away from the door, tension increases within double torsion spring 718. When the arm 720 is released, the tension brings the arm 720 back to a position which is parallel, or nearly parallel, to the surface of the door on which it is used.

Other means of biasing the handle towards the door are within the scope of the present disclosure.

For example, a torsion spring may also be used instead of the double torsion spring shown in the example illustrated in FIG. 7. When a torsion spring is used, the arm of the device may be adapted as shown in FIG. 8.

Figure 8:
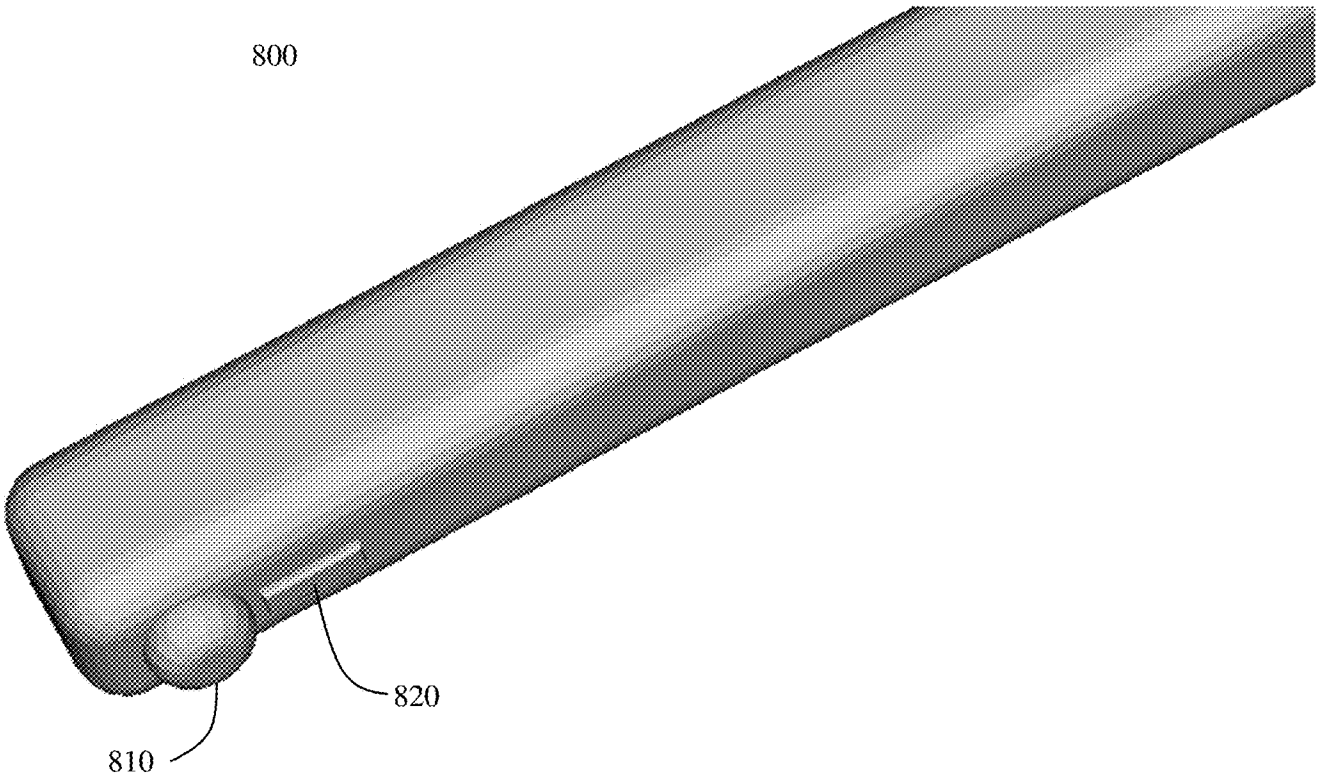
FIG. 8 shows a perspective view of an arm of a device according to at least one embodiment of the present disclosure.

As shown in FIG. 8, arm 800 comprises a pin 810 extending laterally from a side surface of arm 800, near proximal end of arm 800. Arm 800 further comprises a spring holder extension 820, next to pin 810.

The torsion spring has two legs, extending in opposite directions, with a coil in between. One leg of the torsion spring may be secured to the base, and the coil is placed around pin 810, while the other leg of the torsion spring is secured to spring holder extension 820.

During operation, when the handle is extended away from the door, the tension in the spring increases, and as the handle is released the spring retracts the handle towards the door.

In yet another embodiment, an elastic ring may be provided having one end connected to the base and another end at a point on the lower surface of the arm, such that when the handle is extended away from the door, the tension in the elastic increases, and as the handle is released, the elastic retracts the handle towards the door. The elastic ring may be secured through notches provided on the base and on the lower surface of the arm for that purpose.

Figure 9B:
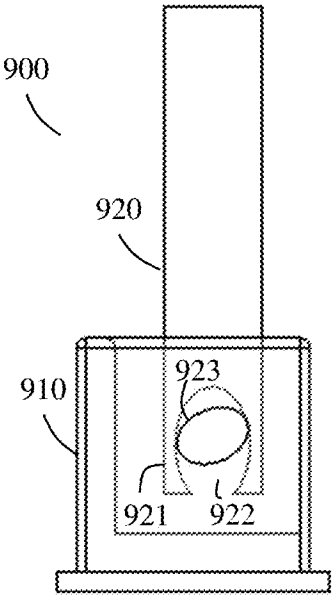
FIG. 9B shows a side view of a device according to at least one embodiment of the present disclosure.
Figure 9A:
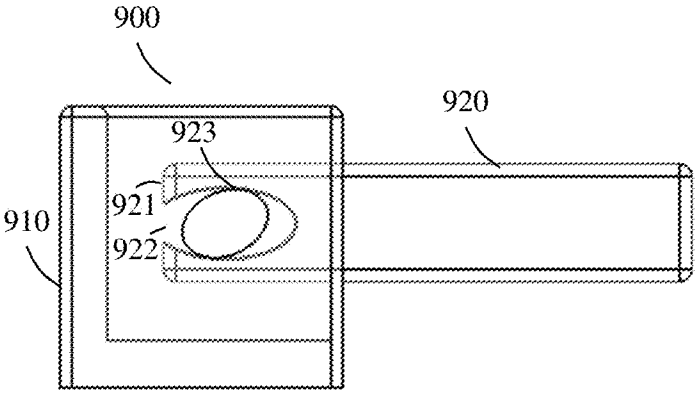
FIG. 9A shows a side view of a device according to at least one embodiment of the present disclosure.

In yet another embodiment, a rotational spring is used. The rotational spring is illustrated in FIG. 9A and FIG. 9B. Specifically, as shown in FIG. 9A, a device 900 includes a base 910, and an arm 920. In this embodiment, the arm 920 is rotationally secured to the base 910 using a novel spring arrangement.

Specifically, as shown in FIG. 9, arm 920 terminates in two members 921 which together create an opening 922. The opening has a generally oval shape, in order to receive internal pin 923, which also has a generally oval cross-section, as shown.

Internal pin 923 is installed such that its cross-section is aligned with the cross-section of opening 922, while the arm 920 is at rest. Internal pin 923 does not rotate with respect to the base 910. For example, in one embodiment, pin 923 is secured to the side walls of base 910.

As seen in FIG. 9A, the arm 920 is positioned such that the internal pin 923 fits within opening 922 without creating any tension in members 921. This allows arm 920 to be secured and at rest in this position.

In FIG. 9B, the arm 920 is positioned 90 degrees from the position shown in FIG. 9A. In this position, the cross section of arm 923 stretches members 921 away from each other, creating tension. According to at least one embodiment, the members 921 and the arm are made from resilient plastic, such that as the arm is rotated to the position shown in FIG. 9B, members 921 are pushed away from each other by internal pin 923. Members 921 being made of resilient material, they naturally exert pressure towards each other as they are pushed away from each other. The more rigid the material, the greater the tension will be created, the more force will be needed to rotate the handle, and the faster the handle will return to its rest position once released. Therefore, when the arm 920 is released, the members 921 apply pressure on internal pin 923, causing the arm 920 to return to its original position shown in FIG. 9A.

Further, as shown in FIG. 9B, internal pin 923 is oriented such that when the arm 920 is fully extended, the arm 920 wont disengage from the internal pin 923. In at least one embodiment, base 910 comprises a stop member (not shown) to prevent the arm 920 from being rotated further than the position shown in FIG. 9B.

Because the cross section of the internal pin 923 is generally oval, as is the cross section of opening 922, the orientation of the opening 922 with respect to internal pin 923 will change the tension between the external surface of internal pin 923 and members 921. Specifically, as the arm 920 rotates, the members 921 will make contact with internal pin 923 at two points which get increasingly further apart from each other. This pushes the members 921 away from each other, thereby creating tension, which is released as the arm 920 is released.

While the embodiment illustrated in FIGS. 9A and 9B comprises the opening 922, some embodiments may omit the opening 922 and instead comprise a surface (now shown) linking both members 921, such that the internal pin is enclosed within the gap defined by members 921. As this may reduce the amount members 921 may move away from each other, rotation of the handle may be restricted as well.

The rotational spring illustrated in FIGS. 9A and 9B could be adapted to different applications than the device to assist in closing doors disclosed herein.

Accordingly the above describes a device for assisting a person in closing a door. While this device is particularly suited to people suffering from disabilities requiring a wheelchair, other people may benefit from use of the device. For example, elderly people (whether in their home or in a retirement home) will benefit from use of a device according to the present disclosure. Furthermore, people working on construction sites will benefit from the use of such a device. More generally, a device according to the present disclosure will be beneficial to anyone having to occasionally reach for a door knob at the far end of a door while they have their hands full, or suffer from limited mobility. A device according to the present disclosure may be attached to any door, including, but not limited to, bathroom doors, office doors, entrances, access doors, and the like.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification or claims refer to at least one of something selected from the group consisting of A, B, C . . . and N, the text should be interpreted as requiring only one element from the group, not A plus N, or B plus N, etc.

The invention claimed is:

1. A device comprising:

a base having a flat surface and an external surface;

an arm extending from the external surface of the base, the arm being secured to the base via a pivoting axis allowing the arm to pivot with respect to the base;

a handle at a distal end of the arm;

a stop member extending upwardly from the base, the stop member being configured to restrict the pivoting of the arm towards the base such that when the arm rests against the stop member the arm is substantially parallel to the base; and biasing means, the biasing means being configured to bias the arm in a direction towards a first position where the arm is in contact with the stop member.

2. The device of claim 1, wherein the arm is fixed with respect to the base.

3. The device of claim 1, wherein the base further comprises at least one shoulder extending upwardly from the external surface.

4. The device of claim 3, wherein the base comprises two shoulders, and wherein the arm comprises a proximal end and a distal end, and wherein the proximal end of the arm is positioned in a cavity defined by the two shoulders.

5. The device of claim 4, wherein the stop member is positioned in the cavity.

6. The device of claim 1, wherein the arm is integrated with the base as a single piece.

7. The device of claim 1, wherein the biasing means is selected from the group consisting of a double torsion spring, a torsion spring, and an elastic ring.

8. A door comprising:

a door body;

a device according to claim 1 secured to the door body.

* * * * *